US010946396B2

(12) United States Patent
Wu et al.

(10) Patent No.: US 10,946,396 B2
(45) Date of Patent: Mar. 16, 2021

(54) SHOWERS

(71) Applicant: Purity (Xiamen) Sanitary Ware Co., Ltd., Xiamen (CN)

(72) Inventors: James Wu, Taichung (TW); Alex Wu, Taichung (TW); Ce-Wen Yang, Xiamen (CN)

(73) Assignee: PURITY (XIAMEN) SANITARY WARE CO., LTD., Fujian (CN)

( * ) Notice: Subject to any disclaimer, the term of this patent is extended or adjusted under 35 U.S.C. 154(b) by 153 days.

(21) Appl. No.: 16/232,379

(22) Filed: Dec. 26, 2018

(65) Prior Publication Data

US 2020/0206757 A1 Jul. 2, 2020

(51) Int. Cl.

| | |
|---|---|
| ***B05B 1/20*** | (2006.01) |
| ***B05B 1/18*** | (2006.01) |
| ***A47K 3/28*** | (2006.01) |
| ***B05B 12/00*** | (2018.01) |
| ***E03C 1/04*** | (2006.01) |
| ***B05B 1/34*** | (2006.01) |
| *B05B 1/16* | (2006.01) |

(52) U.S. Cl.

CPC ..... *B05B 1/205* (2013.01); *A47K 3/281* (2013.01); *B05B 1/185* (2013.01); *B05B 1/3436* (2013.01); *B05B 12/002* (2013.01); *E03C 1/0405* (2013.01); *B05B 1/169* (2013.01)

(58) Field of Classification Search

CPC .. B05B 1/20; B05B 1/205; B05B 1/16; B05B 1/169; B05B 1/1636; B05B 1/1672; B05B 1/1681; B05B 1/185; A47K 3/281; E03C 1/0405

USPC ..... 137/625.46, 625.47

See application file for complete search history.

(56) References Cited

U.S. PATENT DOCUMENTS

| | | | | |
|---|---|---|---|---|
| 9,599,236 | B2 * | 3/2017 | McCoy | F16K 11/0853 |
| 10,119,621 | B2 * | 11/2018 | Breda | E03C 1/023 |
| 10,215,294 | B2 * | 2/2019 | Ferrer Beltran | F16K 27/067 |
| 2007/0044856 | A1 * | 3/2007 | Bonior | F16K 11/0856 137/625.47 |
| 2009/0265848 | A1 * | 10/2009 | Tsai | E03O 1/0408 4/615 |
| 2018/0304279 | A1 * | 10/2018 | Zhu | B05B 1/1636 |

* cited by examiner

*Primary Examiner* — Jason J Boeckmann

(74) *Attorney, Agent, or Firm* — Birch, Stewart, Kolasch & Birch, LLP

(57) ABSTRACT

A shower includes a shower assembly and a control member. The shower assembly includes a main body having a side wall, an end wall, a plurality of outlet bores and an inlet bore, wherein the side wall and end wall are connected to each other to compose an accommodating space. The outlet bores and the inlet bore are positioned on the side wall of the main body, and communicate with each other through the accommodating space. The control member is positioned in the accommodating space of the shower assembly, and has a flow channel and a plurality of through holes. Each of the through holes communicates with each other through the flow channel, and is corresponding to the inlet bore or one of the outlet bores. When the control member is operated, at least one of the through holes communicates with the inlet bore, and another one of the through holes communicates with the corresponding one of the outlet bores.

13 Claims, 11 Drawing Sheets

SHOWERS

BACKGROUND OF THE INVENTION

1. Technical Field

The present disclosure relates generally to a shower, and more particularly to a shower having a controller to control outlet functions.

2. Description of Related Art

Recently, a conventional shower usually has a diverter operator to be operated by users to change outlet functions. However, such diverter operator is usually positioned on a rear side or a hidden side of the conventional shower, which is difficult to be found out or be reached, whereby such diverter operator of the conventional shower is uneasy to operate while users would like to take a shower. In addition, owing to the hidden position of the diverter operator, the user is not easy to check which the outlet functions is chosen when the user changes the outlet functions of the conventional shower.

Accordingly, what is needed is a shower that is easy to change the outlet functions for users during a shower. At least for the above reasons, the conventional showers still have room for improvements.

BRIEF SUMMARY OF THE INVENTION

In view of the above, the primary objective of the present disclosure is to provide a shower having a control member, which is used to conveniently change multiple outlet functions for users during a shower.

The present disclosure provides a shower including a shower assembly and a control member. The shower assembly includes a main body having a side wall, an end wall, a plurality of outlet bores and an inlet bore, wherein the side wall and end wall are connected to each other to compose an accommodating space. The outlet bores and the inlet bore are positioned on the side wall of the main body, and communicate with each other through the accommodating space. The control member is positioned in the accommodating space of the shower assembly, and has a flow channel and a plurality of through holes. Each of the through holes communicates with each other through the flow channel, and is corresponding to the inlet bore or one of the outlet bores. When the control member is operated, at least one of the through holes communicates with the inlet bore, and another one of the through holes communicates with the corresponding one of the outlet bores.

With the aforementioned design, the control member of the shower could be operated to allow one of the through holes communicating with the corresponding one of the outlet bores, and thereby the shower could conveniently change multiple outlet functions for users during a shower.

BRIEF DESCRIPTION OF THE SEVERAL VIEWS OF THE DRAWINGS

The present disclosure will be best understood by referring to the following detailed description of some illustrative embodiments in conjunction with the accompanying drawings, in which.

DETAILED DESCRIPTION OF THE INVENTION

Figure 1:
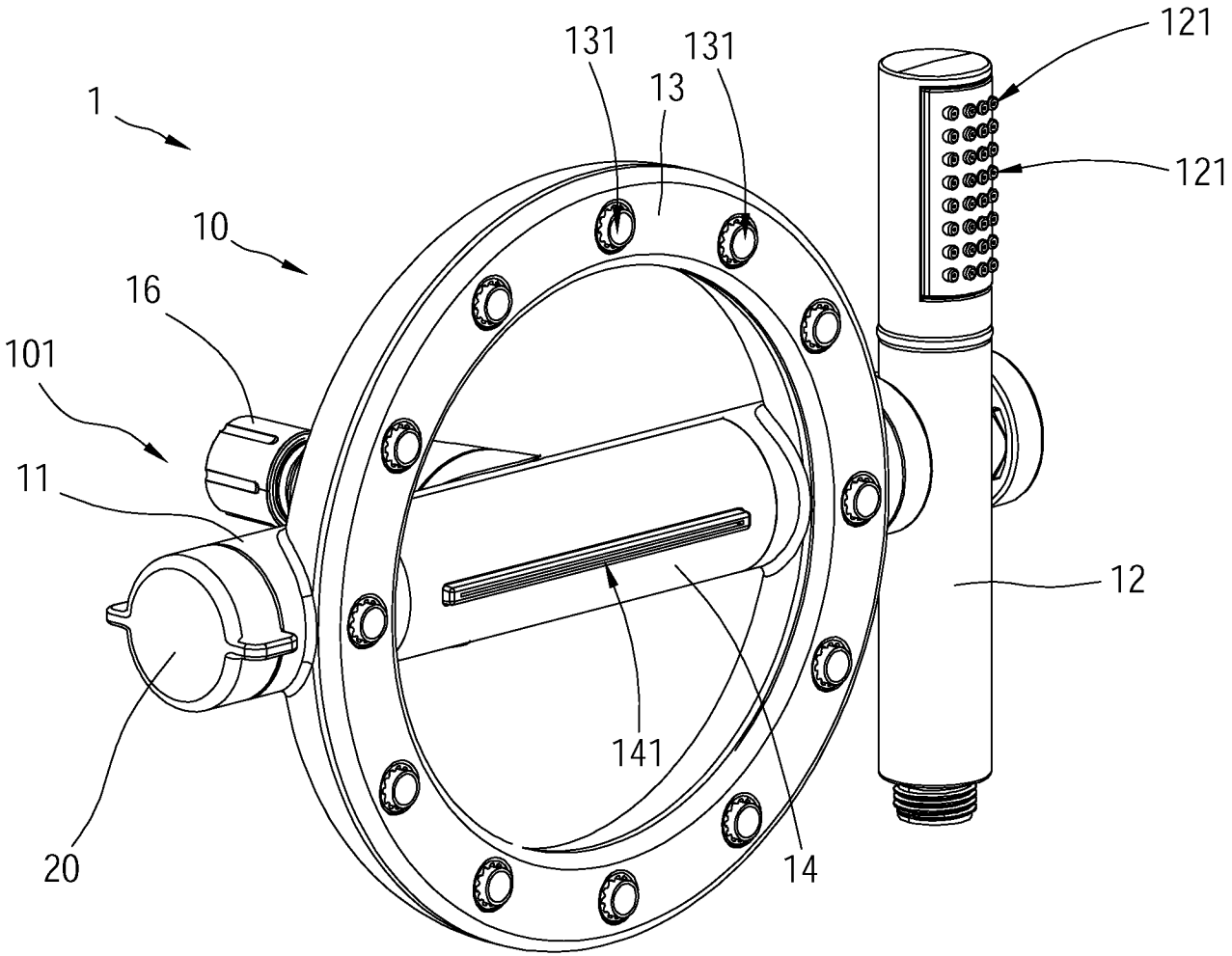
FIG. 1 is a perspective view of a shower of one embodiment of the present disclosure.
Figure 2:
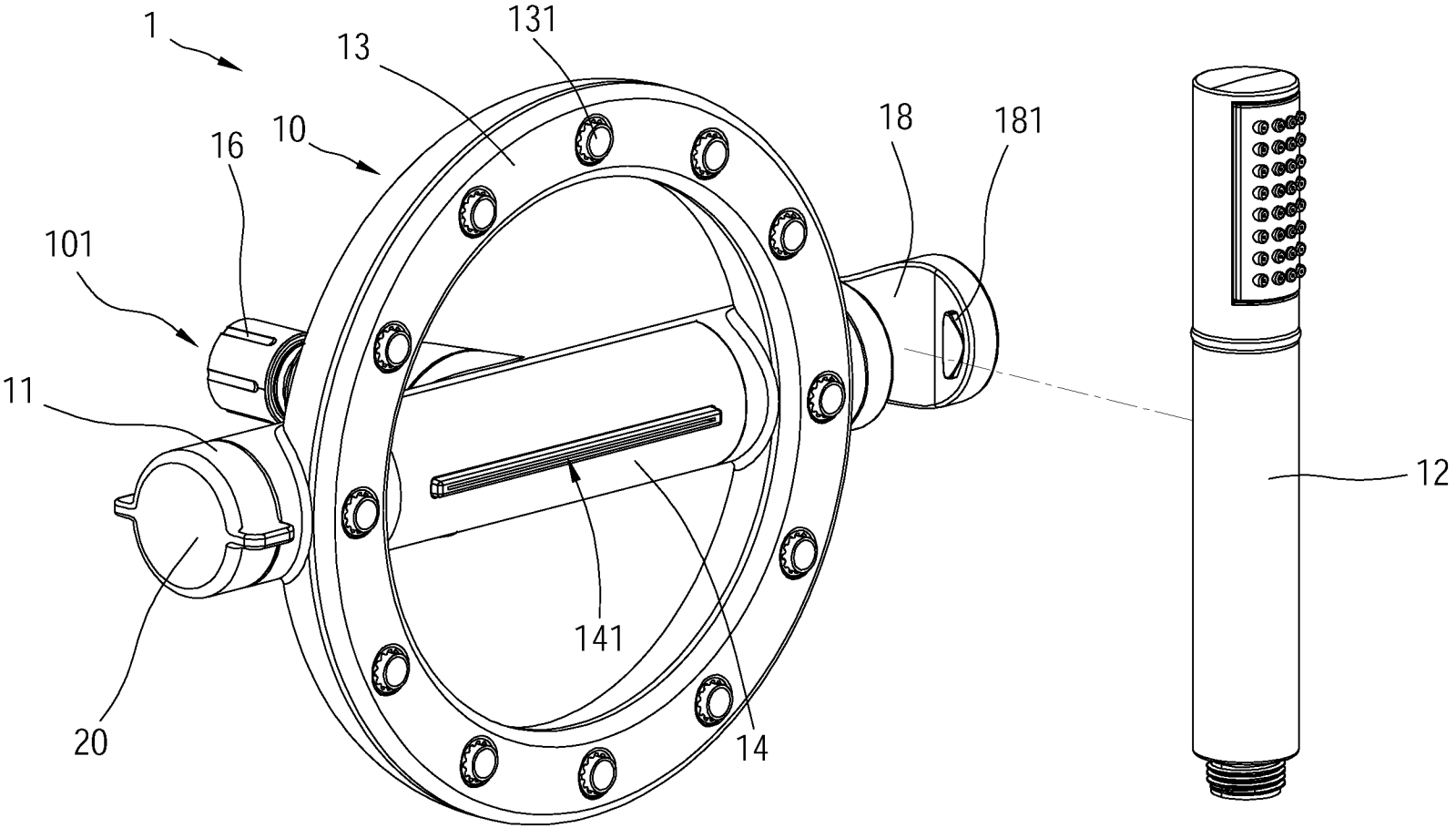
FIG. 2 is a partial exploded view of the shower of one embodiment of the present disclosure.
Figure 3:
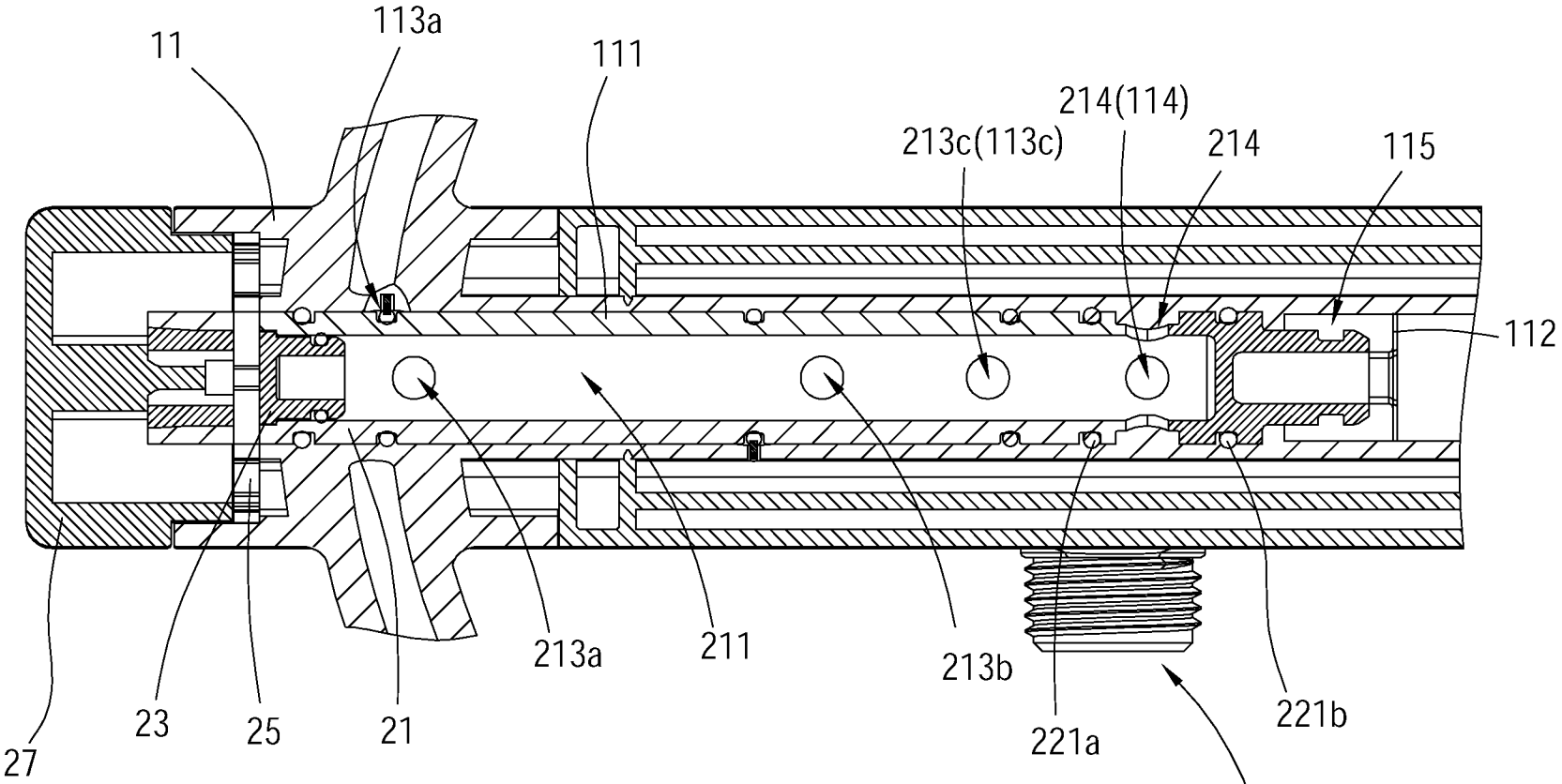
FIG. 3 is a partial cross-sectional view of the shower of one embodiment of the present disclosure.

As illustrated in FIG. 1 to FIG. 11, a shower 1 is provided, including a shower assembly 10 and a control member 20. The shower assembly 10 includes a main body 11 having a side wall 111, an end wall 112, a plurality of outlet bores 113*a*, 113*b*, 113*c* and an inlet bore 114. In FIG. 3, the side wall 111 and the end wall 112 are connected to each other to compose an accommodating space 115. In one embodiment of the present disclosure, the outlet bores 113*a*, 113*b*, 113*c* and the inlet bore 114 are positioned on the side wall 111 of the main body 11, and communicate with each other through the accommodating space 115.

The control member 20 is positioned in the accommodating space 115 of the shower assembly 10, and has a flow channel 211 and a plurality of through holes 213*a*, 213*b*, 213*c*, 214. In addition, in FIG. 3, the accommodating space 115 is in a rod shape; the control member 20 includes a longitudinal tube 11, which could rotate relative to the shower assembly 10.

In one embodiment of the present disclosure, each of the through holes 213*a*, 213*b*, 213*c*, 214 communicates with each other through the flow channel 211. Furthermore, each of the through holes 213*a*, 213*b*, 213*c*, 214 is corresponding to the inlet bore 114 or one of the outlet bores 113*a*, 113*b*, 113*c*. In other words, the through holes 214 are corresponding to the inlet bore 114. The through holes 213*a* is corresponding to the outlet bores 113*a*. The through holes 213*b* is corresponding to the outlet bores 113*b*. The through holes 213*c* is corresponding to the outlet bores 113*c*.

In one embodiment of the present disclosure, when the control member 20 is operated, at least one of the through holes 214 communicates with the inlet bore 114, and another one of the through holes 213*a*, 213*b*, 213*c* communicates with the corresponding one of the outlet bores 113*a*, 113*b*, 113*c*. In other words, at least one of the through holes 214 could communicate with the inlet bore 114. The through hole 213*a* communicates with the corresponding one of the outlet bores 113*a*. The through hole 213*b* communicates with the corresponding one of the outlet bores 113*b*. The through hole 213*c* communicates with the corresponding one of the outlet bores 113*c*. In FIG. 3, the inlet bore 114, the through holes 213*a*, 213*b*, 213*c*, 214 and the flow channel 211 communicate with each other.

In one embodiment of the present disclosure, the control member 20 includes a plurality of adjusting positions relative to the shower assembly 10. When the control member 20 stays at one of the adjusting positions, one of the through holes 213*a*, 213*b*, 213*c* communicates with the corresponding one of the outlet bores 113*a*, 113*b*, 113*c*. In other words, when the control member 20 stays at a first one of the adjusting positions, the through holes 213*a* communicates with the corresponding outlet bore 113*a*; when the control member 20 stays at a second one of the adjusting positions, the through holes 213*b* communicates with the corresponding outlet bore 113*b*; when the control member 20 stays at a third one of the adjusting positions, the through holes 213*c* communicates with the corresponding outlet bore 113*c*.

Figure 5:
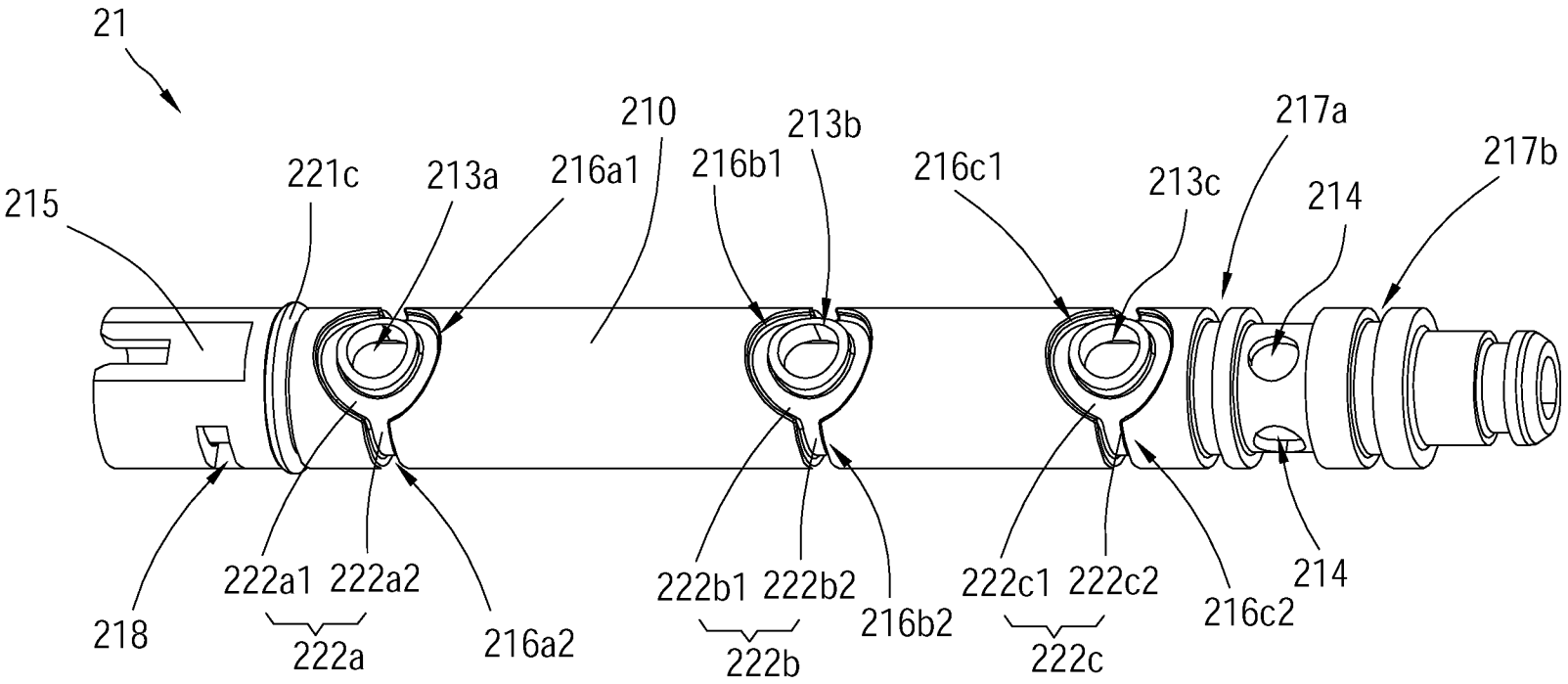
FIG. 5 is a perspective view of a longitudinal tube of the shower of one embodiment of the present disclosure.
Figure 6:
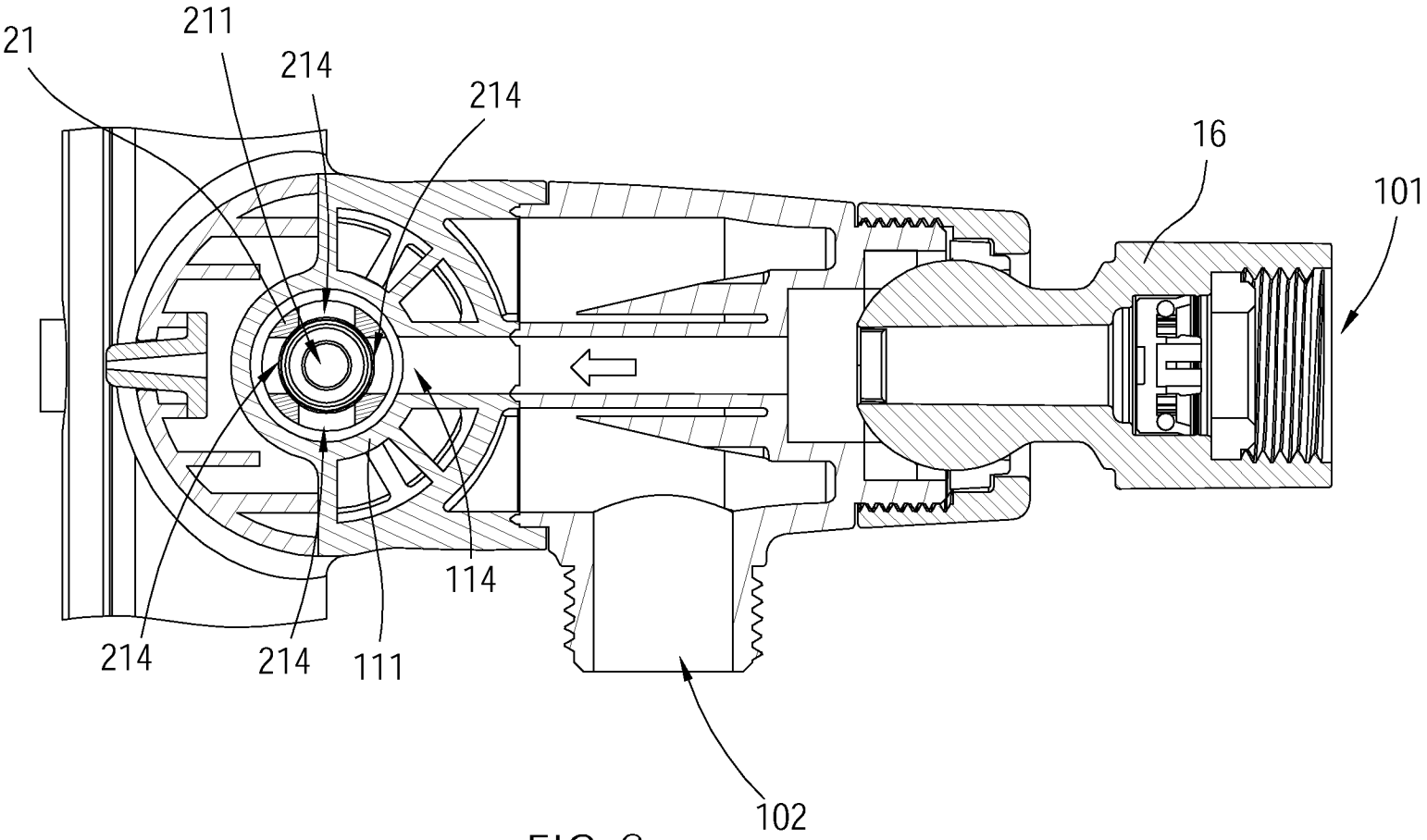
FIG. 6 is a partial cross-sectional view of the shower of one embodiment of the present disclosure.
Figure 7:
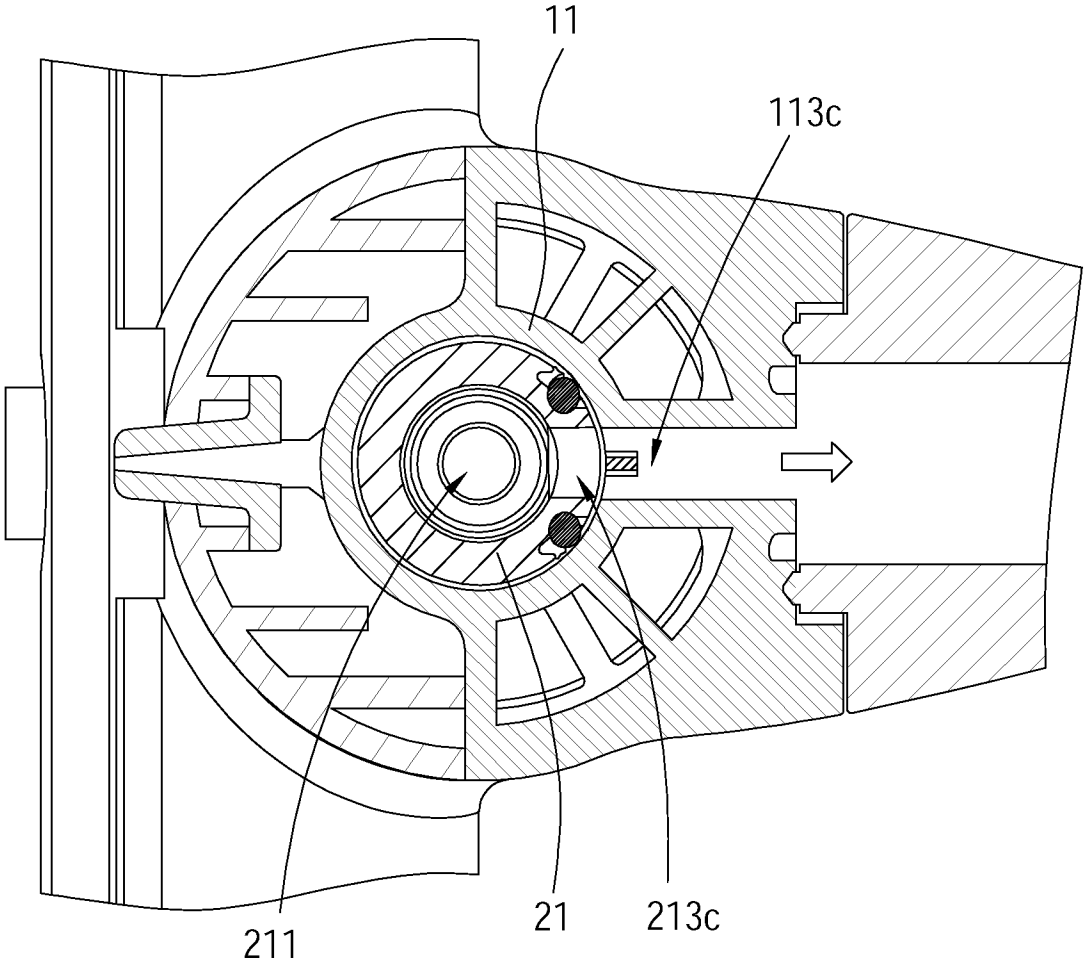
FIG. 7 is a partial cross-sectional view of the shower of one embodiment of the present disclosure.

In FIG. 5, the longitudinal tube 21 includes an inlet section (near the through holes 214) and a plurality of outlet sections (respectively near the through hole 213*a*, 213*b*, 213*c*), the inlet section and the outlet sections are separated from each other on an outer surface 210 of the longitudinal tube 21, but communicate with the flow channel 211 in an inner space of the longitudinal tube 21. The inlet section has at least one of the through holes 214 positioned correspondingly to the inlet bore 114, and each of the outlet sections has one of the through holes 213*a*, 213*b*, 213*c* positioned correspondingly to the corresponding one of the outlet bores 113*a*, 113*b*, 113*c*.

In one embodiment of the present disclosure, the through bores 213*a*, 213*b*, 213*c* located on the corresponding outlet sections are open on a tube wall of the longitudinal tube 21 in different radial directions.

Figure 4:
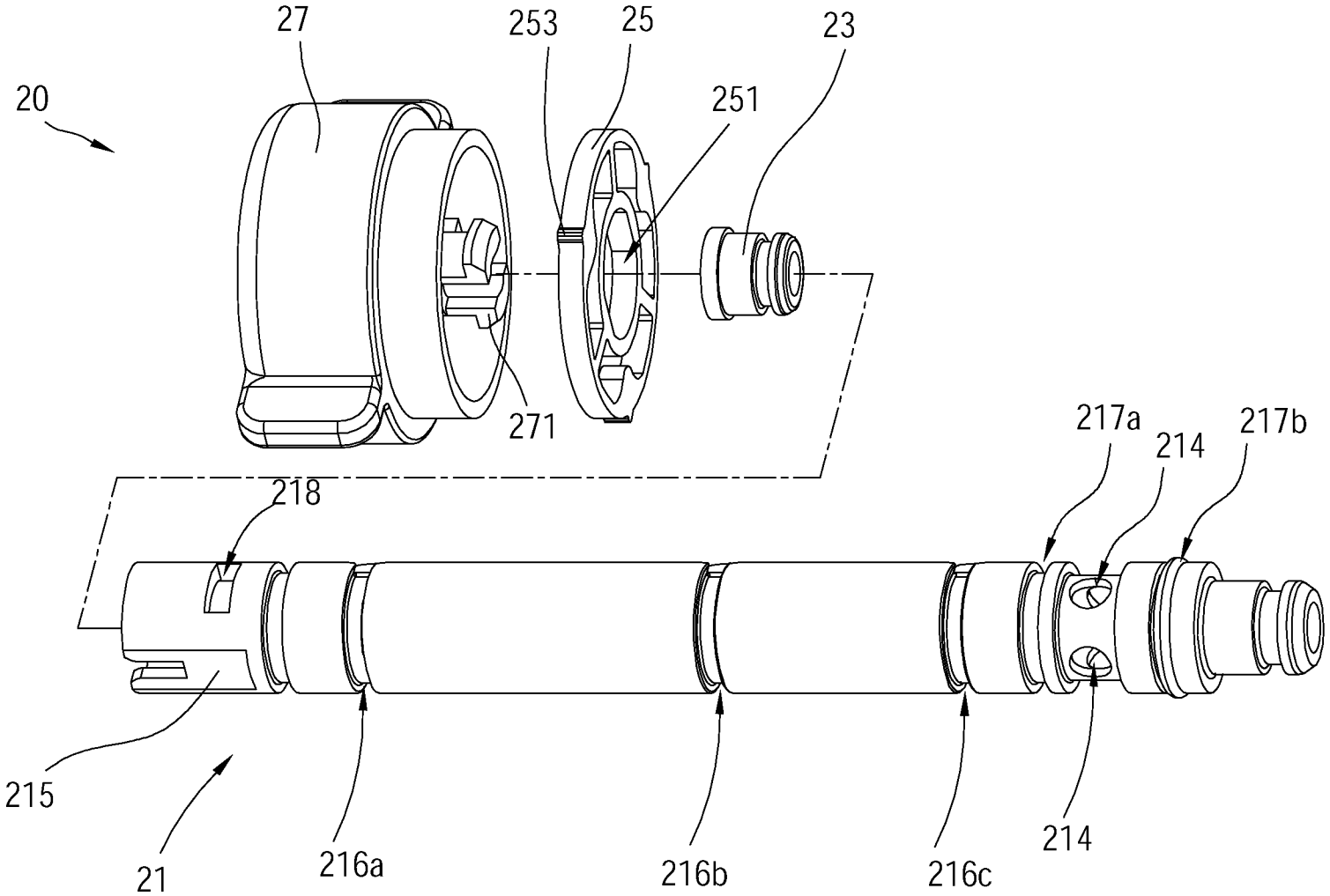
FIG. 4 is an exploded view of a control member of the shower of one embodiment of the present disclosure.

In FIG. 3, FIG. 4 and FIG. 5, the inlet section includes two circular recesses 217*a*, 217*b* circularly positioned on the outer surface 210 of the longitudinal tube 21. The two circular recesses 217*a*, 217*b* are respectively circularly positioned on two ends of the inlet section. A sealing ring 221*a* is positioned on the circular recess 217*a* while another sealing ring 221*b* is positioned on the circular recess 217*b*.

Furthermore, each of the outlet sections includes a circular recess 213*a*, 213*b* or 213*c* circularly positioned on the outer surface 210 of the longitudinal tube 21. The circular recess 216*a* winds around one of the through hole 213*a* located on the corresponding outlet section. A sealing ring 222*a* is positioned in the circular recess 216*a*. The circular recess 216*b* winds around one of the through hole 213*b* located on the corresponding outlet section. A sealing ring 222*b* is positioned in the circular recess 216*b*. The circular recess 216*c* winds around one of the through hole 213*c* located on the corresponding outlet section. A sealing ring 222*c* is positioned in the circular recess 216*c*.

In one embodiment of the present disclosure, the circular recess 216*a* includes a first winding section 216*a*1 and a section winding section 216*a*2. The first winding section 216*a*1 winds around the through hole 213*a* located on the corresponding outlet section and the second winding section 216*a*2 winds around the longitudinal tube 21 located on the corresponding outlet section. The sealing ring 222*a* includes a first winding portion 222*a*1 and a second winding portion 222*a*2 connected to each other, wherein the first winding portion 222*a*1 is correspondingly positioned in the first winding section 216*a*1 of the circular recess 216*a*, and the second winding portion 222*a*2 is correspondingly positioned in the second winding section 216*a*2 of the circular recess 216*a*.

The circular recess 216*b* includes a first winding section 216*b*1 and a section winding section 216*b*2. The first winding section 216*b*1 winds around the through hole 213*b* located on the corresponding outlet section and the second winding section 216*b*2 winds around the longitudinal tube 21 located on the corresponding outlet section. The sealing ring 222*b* includes a first winding portion 222*b*1 and a second winding portion 222*b*2 connected to each other, wherein the first winding portion 222*b*1 is correspondingly positioned in the first winding section 216*b*1 of the circular recess 216*b*, and the second winding portion 222*b*2 is correspondingly positioned in the second winding section 216*b*2 of the circular recess 216*b*.

The circular recess 216*c* includes a first winding section 216*c*1 and a section winding section 216*c*2. The first winding section 216*c*1 winds around the through hole 213*c* located on the corresponding outlet section and the second winding section 216*c*2 winds around the longitudinal tube 21 located on the corresponding outlet section. The sealing ring 222*c* includes a first winding portion 222*c*1 and a second winding portion 222*c*2 connected to each other, wherein the first winding portion 222*c*1 is correspondingly positioned in the first winding section 216*c*1 of the circular recess 216*c*, and the second winding portion 222*c*2 is correspondingly positioned in the second winding section 216*c*2 of the circular recess 216*c*.

Figure 11:
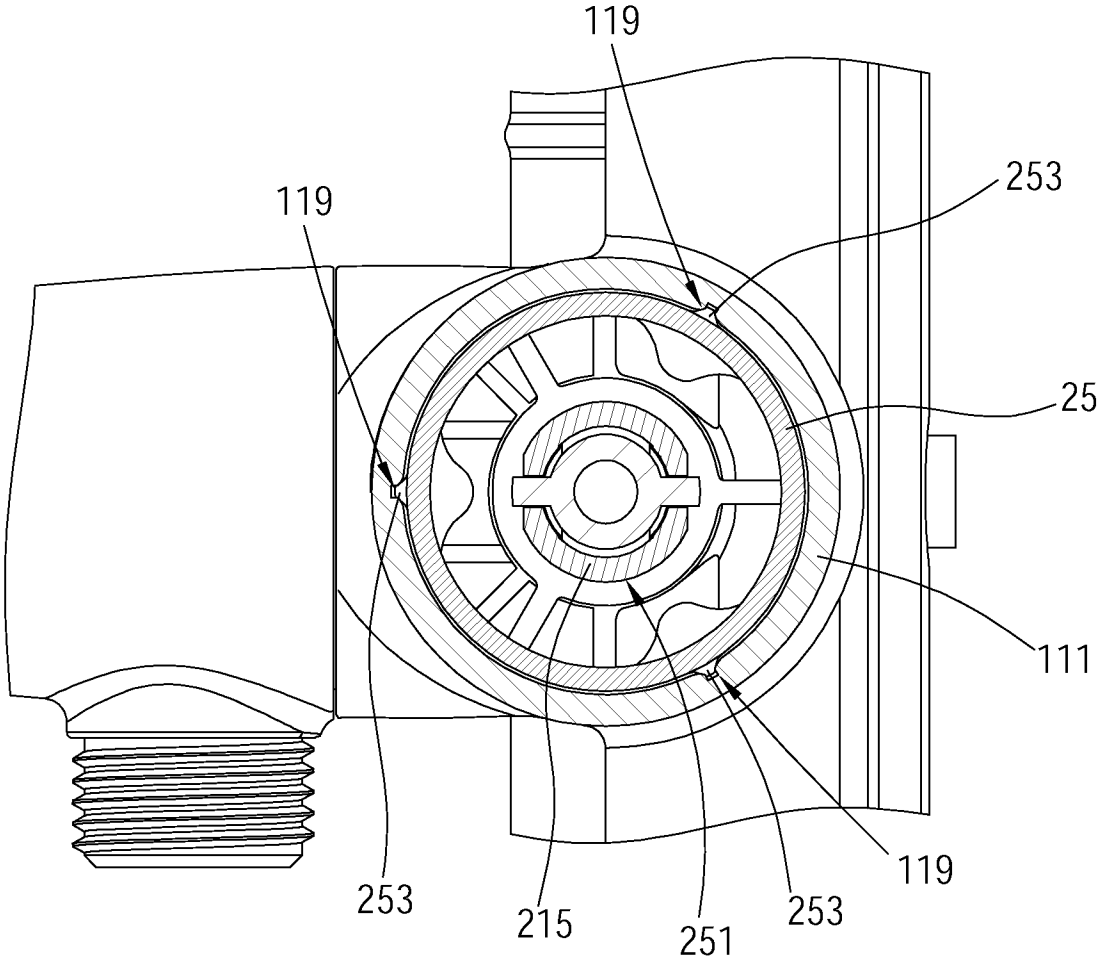
FIG. 11 is a partial cross-sectional view of the shower of one embodiment of the present disclosure.

Referring to FIG. 4 and FIG. 11, the control member 20 includes a positioning ring 25 circularly positioned on an end of the longitudinal tube 21. The positioning ring 25 could rotate along with the longitudinal tube 21 relative to the shower assembly 10. The positioning ring 25 has a plurality of positioning protrusions 253 positioned on an outer surface of the positioning ring 25, and the side wall 111 of the main body 11 has a plurality of positioning recesses 119 positioned on an inner surface of the side wall 111. When the longitudinal tube 21 drives the positioning ring 25 to stay at one of the adjusting positions, the positioning protrusions 253 are respectively positioned in the positioning recesses 119.

It is worthy to note that, when the longitudinal tube 21 drive the positioning ring 25 to rotate to one of the adjusting positions, the positioning protrusions 253 respectively insert into the positioning recesses 119, which generates a positioning tone to voice the user that the longitudinal tube 21 is located in one of the adjusting positions, and thereby one of the through holes 213*a*, 213*b*, 213*c* communicates with the corresponding one of the outlet bores 113*a*, 113*b*, 113*c*.

Additionally, in FIG. 4 and FIG. 11, the positioning ring 25 has a non-circular axial hole 251, and the end of the longitudinal tube 21 is a non-circular axial post 215. The non-circular axial hole 251 and the non-circular axial post 215 are correspondingly fitted to each other, whereby the positioning ring 25 could rotate along with the longitudinal tube 21 relative to the shower assembly 10.

Referring to FIG. 3 and FIG. 4, the control member 20 has an end plug 23 for plugging into an opening of the longitudinal tube 21 which communicates with the flow channel 211.

In FIG. 3 and FIG. 4, the control member 20 has a rotation cap 27 connected to an end of the longitudinal tube 21. The rotation cap 27 has an elastic lock 271, and the end of the longitudinal tube 21 has a slot 218. The elastic lock 271 has a flange passing through the slot 218, whereby the rotation cap 27 and the longitudinal tube 21 could synchronously rotate with each other.

Figure 10:
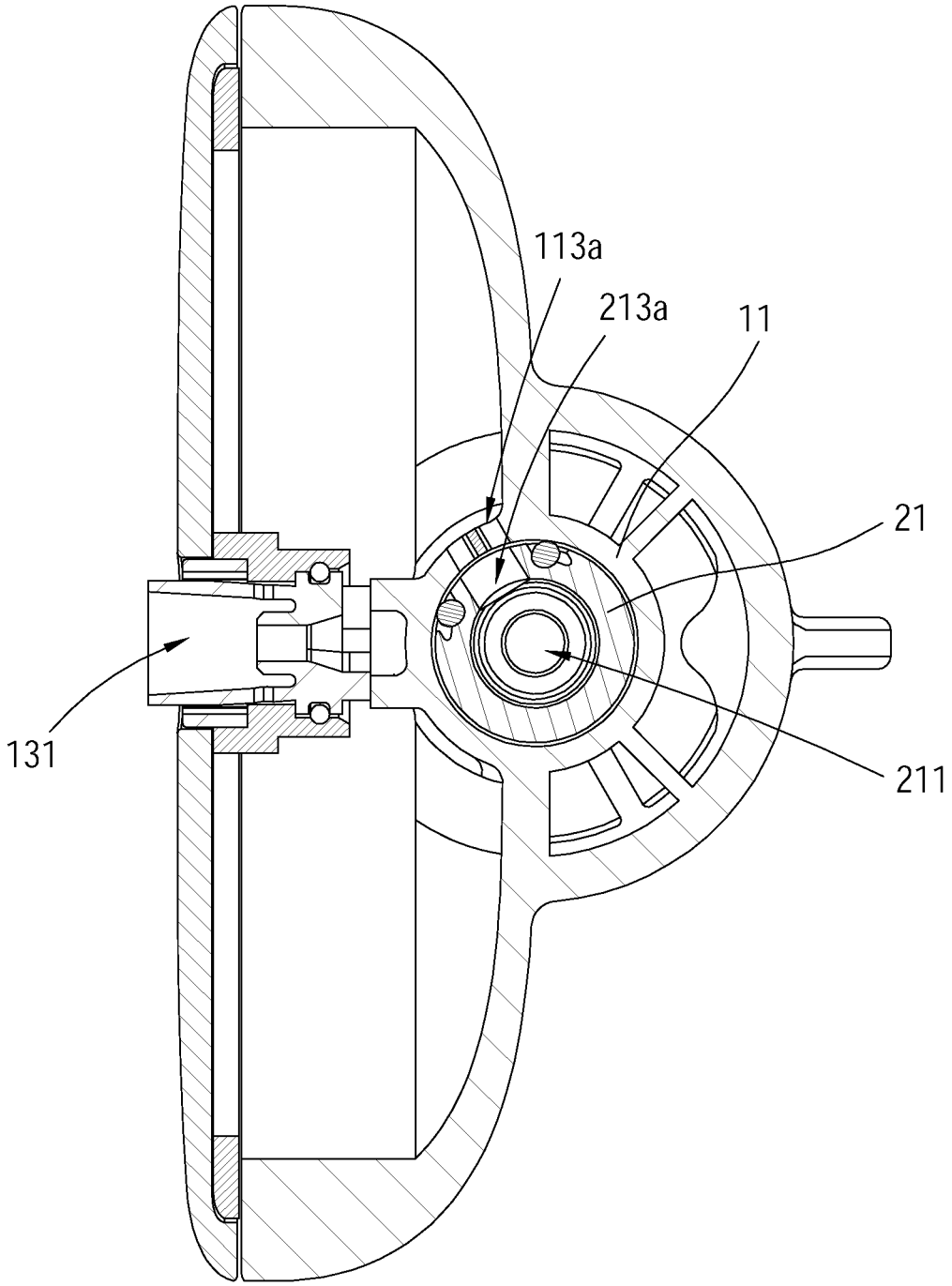
FIG. 10 is a partial cross-sectional view of the shower of one embodiment of the present disclosure.

Referring to FIG. 1, FIG. 2 and FIG. 10, the shower assembly 10 includes a circular outlet unit 13 connected to the main body 11. The circular outlet unit 13 has a plurality of nozzles 131. The nozzles 131 are positioned on an outer surface of the circular outlet unit 13 in interval, and communicate with the outlet bore 113*a*. When the longitudinal tube 21 rotates to stay at one of the adjusting positions, the nozzles 131 communicate with the through hole 213*a*, and thereby water could outlet from the nozzles 131.

Figure 9:
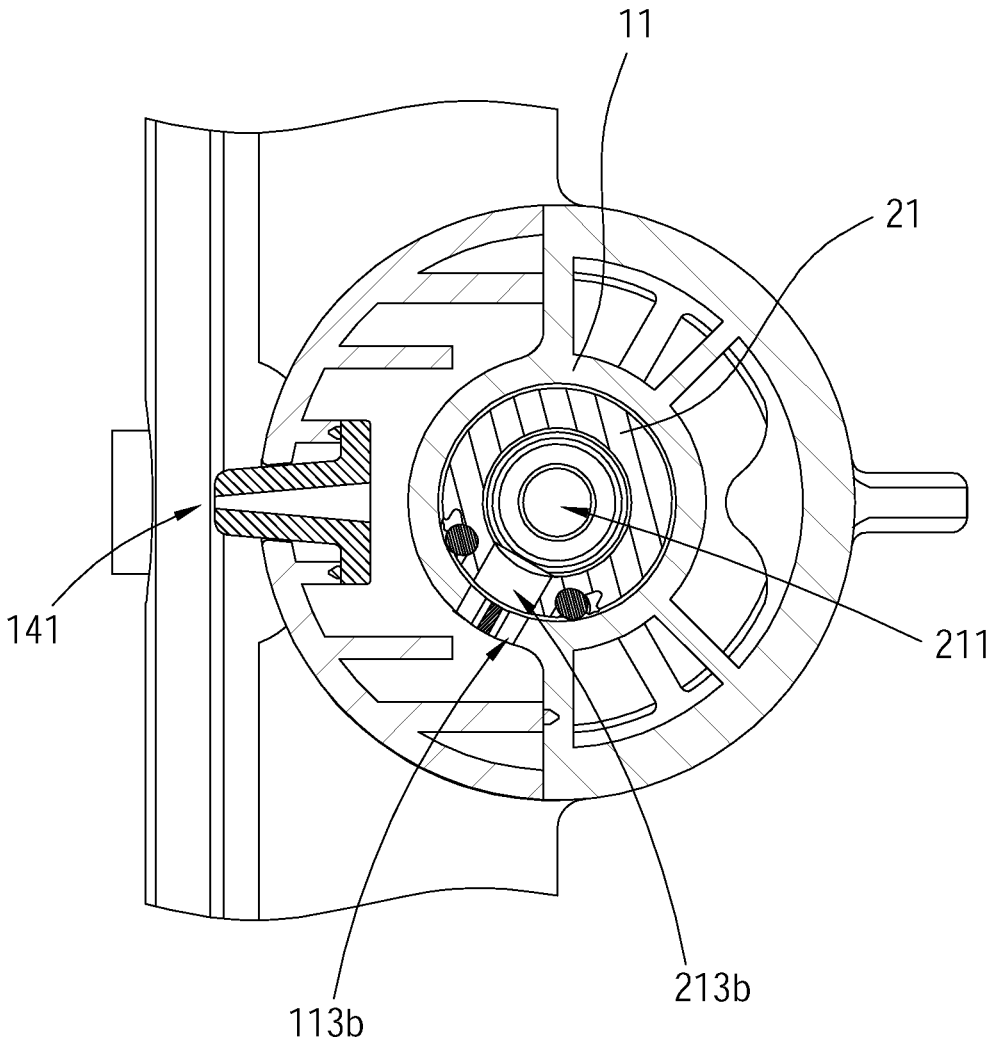
FIG. 9 is a partial cross-sectional view of the shower of one embodiment of the present disclosure.

Referring to FIG. 1, FIG. 2 and FIG. 9, the shower assembly 10 includes a narrow longitudinal outlet unit 14 connected to the main body 11. The narrow longitudinal outlet unit 14 has an outlet slot 141 which communicates with the outlet bore 113*b*. When the longitudinal tube 21 rotates to stay at one of the adjusting positions, the outlet slot 141 communicate with the through hole 213*b*, and thereby water could outlet from the outlet slot 141.

Figure 8:
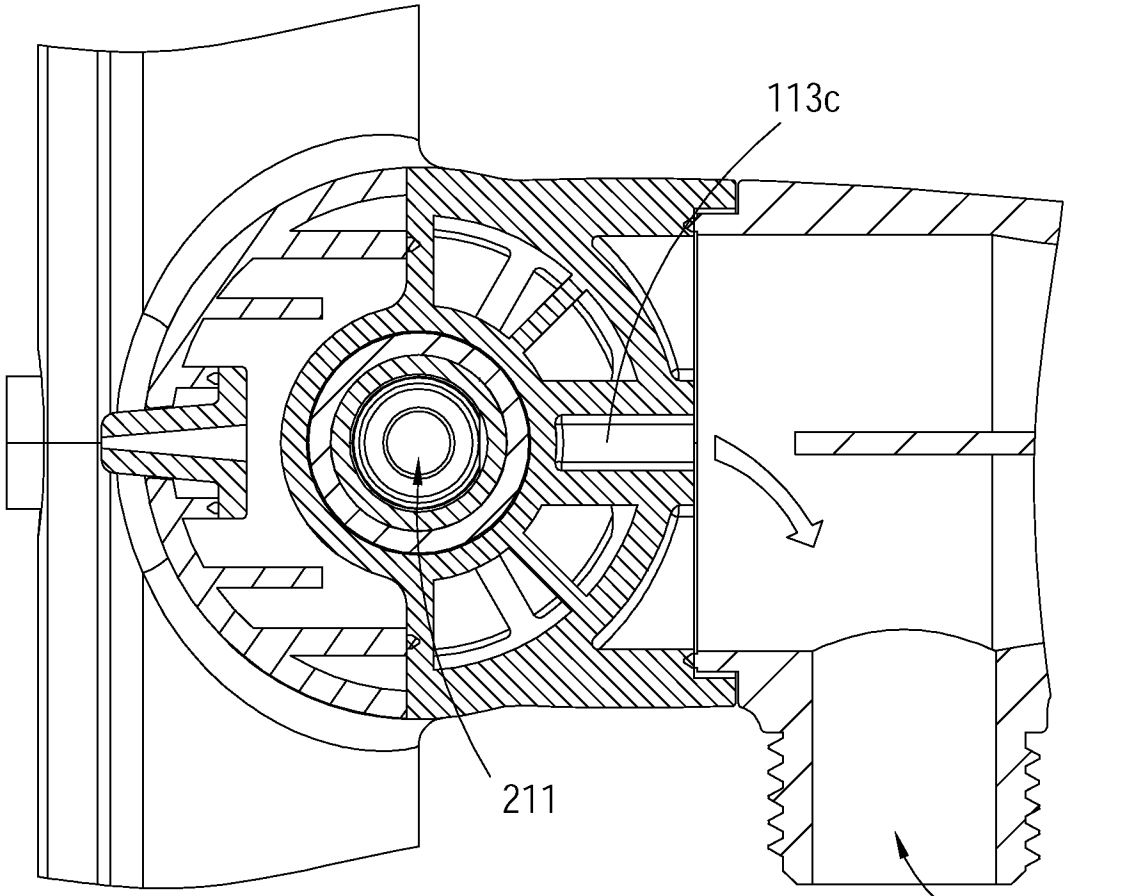
FIG. 8 is a partial cross-sectional view of the shower of one embodiment of the present disclosure.

Referring to FIG. 1, FIG. 2, FIG. 7 and FIG. 8, the shower assembly 10 includes a sprayer 12 connected to the main body 11. The sprayer 12 has a plurality of nozzles 121 which communicate with the outlet bore 113*c*. In one embodiment of the present disclosure, the outlet bore 113*c* communicates with an outlet opening 102, as shown in FIG. 8, and a connecting pipe (not shown) is connected between the outlet opening 102 and the sprayer 12. When the longitudinal tube 21 rotates to stay at one of the adjusting positions, the nozzles 121 communicate with the through hole 213*c*, and thereby water could outlet from the nozzles 121.

In FIG. 1 and FIG. 2, the shower assembly 10 includes a clamping base 18 connected to the main body 11. The clamping base 18 is positioned for detachably clamping the sprayer 12. The clamping base 18 includes an elastic protrusion 181 positioned in a recess of the clamping base 18. The elastic protrusion 181 is adapted to clamp the sprayer 12.

According to embodiments of the present disclosure, the clamping base 18 is rotatably connected to the main body 11. The clamping base 18 has a first restriction position and a second restriction position to respectively restrict a plurality of tilting angles of the clamping base 11. When the clamping base 18 is at the first restriction position, and the sprayer 12 is positioned on the clamping base 18, an outlet direction of the sprayer 12 and an outlet direction of the circular outlet unit 13 are in the same direction. When the clamping base 18 is at the second restriction position, and the sprayer 12 is positioned on the clamping base 18, the sprayer 12 would spray forwardly and downwardly. In embodiments of the present disclosure, the tilting angles of the clamping base are less than or equal to 35°. In embodiments of the present disclosure, the clamping base could be tilted from an elevation angle of −20° to a depression angle of +15°.

In one embodiment of the present disclosure, the inlet bore 114 of the main body 11 communicates with an inlet hole 101 positioned on an inlet connector 16. The inlet connector 16 is connected to the main body 11. The inlet connector 16 includes a universal joint connected to the main body 11.

With the aforementioned design, the control member of the shower could be operated to allow one of the through holes communicating with the corresponding one of the outlet bores, and thereby the shower could conveniently change multiple outlet functions for users during a shower.

It must be pointed out that the embodiments described above are only some preferred embodiments of the present disclosure. All equivalent structures which employ the concepts disclosed in this specification and the appended claims should fall within the scope of the present disclosure.

What is claimed is:

1. A shower, comprising;

a shower assembly, comprising a main body having a side wall, an end wall, a plurality of outlet bores and an inlet bore, wherein the side wall and the end wall are connected to each other to compose an accommodating space; the outlet bores and the inlet bore are positioned on the side wall of the main body, and communicate with each other through the accommodating space; and a control member, positioned in the accommodating space of the shower assembly, and having a flow channel and a plurality of through holes, wherein each of the through holes communicates with each other through the flow channel; each of the through holes is corresponding to the inlet bore or one of the outlet bores; when the control member is operated, at least one of the through holes communicates with the inlet bore, and another one of the through holes communicates with the corresponding one of the outlet bores;

wherein the accommodating space is in a rod shape; the control member comprises a longitudinal tube having a central axis which could rotate relative to the shower assembly;

wherein the through holes of control member which are corresponding to the outlet bores of the shower assembly are arranged in a line parallel to the central axis of the longitudinal tube, the outlet bores of the shower assembly are arranged in a misaligned arrangement in longitudinal and radial directions;

wherein the longitudinal tube comprises an inlet section and a plurality of outlet sections, the inlet section and the outlet sections are separated from each other on an outer surface of the longitudinal tube, but communicate with the flow channel in an inner space of the longitudinal tube; the inlet section has at least one of the through holes positioned correspondingly to the inlet bore, and each of the outlet sections has one of the through holes positioned correspondingly to the corresponding one of the outlet bores;

wherein each of the outlet sections comprises a circular recess circularly positioned on the outer surface of the longitudinal tube, the circular recess winds around one of the through hole located on the corresponding outlet section; a sealing ring is positioned in the circular recess;

wherein the circular recess comprises a first winding section and a second winding section, the first winding section winds around the through hole located on the corresponding outlet section and the second winding section winds around the longitudinal tube located on the corresponding outlet section, the sealing ring comprises a first winding portion and a second winding portion, the first winding portion is correspondingly positioned in the first winding section of the circular recess, and the second winding portion is correspondingly positioned in the second winding section of the circular recess;

wherein the shower assembly comprises a sprayer having a plurality of nozzles, the nozzles communicate with one of the outlet bores; wherein the shower assembly comprises a clamping base connected to the main body, the clamping base is positioned for detachably clamping the sprayer;

wherein the clamping base comprises an elastic protrusion positioned in a recess of the clamping base, the elastic protrusion is adapted to clamp the sprayer.

2. The shower of claim 1, wherein the inlet bore, the through holes and the flow channel communicate with each other.

3. The shower of claim 1, wherein the control member comprises a plurality of adjusting positions relative to the shower assembly; when the control member stays at one of the adjusting positions, one of the through holes communicates with the corresponding one of the outlet bores.

4. The shower of claim 1, wherein the through bores located on the corresponding outlet sections are open on a tube wall of the longitudinal tube in different radial directions.

5. The shower of claim 1, wherein the inlet section comprises two circular recesses circularly positioned on the outer surface of the longitudinal tube, the two circular recesses are respectively circularly positioned on two ends of the inlet section; a sealing ring is positioned on one of the circular recesses while another sealing ring is positioned on the other one of the circular recesses.

6. The shower of claim 3, wherein the control member comprises a positioning ring circularly positioned on an end of the longitudinal tube, and the positioning ring could rotate along with the longitudinal tube relative to the shower assembly; the positioning ring has a plurality of positioning protrusions positioned on an outer surface of the positioning ring, and the side wall of the main body has a plurality of positioning recesses positioned on an inner surface of the side wall; when the longitudinal tube drives the positioning ring to stay at one of the adjusting positions, the positioning protrusions are respectively positioned in the positioning recesses.

7. The shower of claim 6, wherein when the longitudinal tube drive the positioning ring to rotate to one of the adjusting positions, the positioning protrusions respectively insert into the positioning recesses, which generates a positioning tone to voice that the longitudinal tube is located in one of the adjusting positions.

8. The shower of claim 6, wherein the positioning ring has a non-circular axial hole, and the end of the longitudinal tube is a non-circular axial post; the non-circular axial hole and the non-circular axial post are correspondingly fitted to each other, whereby the positioning ring could rotate along with the longitudinal tube relative to the shower assembly.

9. The shower of claim 1, wherein the shower assembly comprises a circular outlet unit connected to the main body, the circular outlet unit has a plurality of nozzles; the nozzles are positioned on an outer surface of the circular outlet unit in interval; the nozzles communicate with one of the outlet bores.

10. The shower of claim 1, wherein the shower assembly comprises a longitudinal outlet unit having an outlet slot, the outlet slot communicates with one of the outlet bores.

11. The shower of claim 1, wherein the clamping base is rotatably connected to the main body.

12. The shower of claim 1, wherein the clamping base has a first restriction position and a second restriction position to respectively restrict a plurality of tilting angles of the clamping base.

13. The shower of claim 12, wherein the tilting angles of the clamping base are less than or equal to 35°.

* * * * *